US007387165B2

(12) United States Patent
Lopez de Cardenas et al.

(10) Patent No.: US 7,387,165 B2
(45) Date of Patent: Jun. 17, 2008

(54) SYSTEM FOR COMPLETING MULTIPLE WELL INTERVALS

(75) Inventors: Jorge Lopez de Cardenas, Sugar Land, TX (US); Gary L. Rytlewski, League City, TX (US); Matthew R. Hackworth, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 256 days.

(21) Appl. No.: 10/905,073

(22) Filed: Dec. 14, 2004

(65) Prior Publication Data

US 2006/0124310 A1 Jun. 15, 2006

(51) Int. Cl.
*E21B 34/14* (2006.01)
*E21B 43/14* (2006.01)

(52) U.S. Cl. ..... 166/313; 166/373; 166/332.4

(58) Field of Classification Search ..... 166/373, 166/313, 386, 320, 329, 332.4, 50, 285, 177.4
See application file for complete search history.

(56) References Cited

U.S. PATENT DOCUMENTS 2,223,442 A * 12/1940 Crowell ..... 166/289
2,374,169 A * 4/1945 Martin ..... 166/147
2,429,912 A * 10/1947 Baker ..... 137/496
2,458,278 A * 1/1949 Larkin ..... 166/149
3,270,814 A * 9/1966 Richardson et al. ..... 166/291
3,333,635 A * 8/1967 Crawford ..... 166/276
3,542,127 A * 11/1970 Malone ..... 166/122
4,099,563 A 7/1978 Hutchison et al.
4,429,747 A * 2/1984 Williamson, Jr. ..... 166/321
4,520,870 A * 6/1985 Pringle ..... 166/317
4,709,760 A * 12/1987 Crist et al. ..... 166/285
4,880,059 A * 11/1989 Brandell et al. ..... 166/332.4
4,949,788 A * 8/1990 Szarka et al. ..... 166/285
5,029,644 A 7/1991 Szarka et al.
5,048,611 A * 9/1991 Cochran ..... 166/374
5,224,556 A 7/1993 Wilson et al.
5,242,022 A * 9/1993 Burton et al. ..... 166/386
5,361,856 A 11/1994 Surjaatmadja et al.
5,368,098 A * 11/1994 Blizzard et al. ..... 166/100
5,375,661 A * 12/1994 Daneshy et al. ..... 166/278
5,381,862 A * 1/1995 Szarka et al. ..... 166/212

(Continued)

OTHER PUBLICATIONS

Thomson, D.W. and Nazroo, M.F.; "Design and Installation of a Cost-Effective Completion System for Horizontal Chalk Wells Where Multiple Zones Require Acid Stimulation"; Offshore Technology Conference, May 1997, Houston, Texas; SPE 51177 (a revision of SPE 39150).

*Primary Examiner*—David J. Bagnell
*Assistant Examiner*—David Andrews
(74) *Attorney, Agent, or Firm*—Fred G. Pruner; Daryl R. Wright; Bryan P. Galloway

(57) ABSTRACT

A system for completing a well with multiple zones of production includes a casing having a plurality of valves that are integrated therein for isolating each well zone. Communication is established between each underlying formation and the interior of the casing, and a treatment fluid is delivered to each of the multiple well zones. Mechanisms for actuating one or more of the valves include, but are not limited to, a dart, a drop ball, a running tool, and a control line actuating system.

9 Claims, 14 Drawing Sheets

U.S. PATENT DOCUMENTS 5,394,941 A * 3/1995 Venditto et al. ..... 166/255.2
5,598,890 A * 2/1997 Richard et al. ..... 166/276
5,765,642 A 6/1998 Surjaatmadja
6,009,947 A 1/2000 Wilson et al.
6,186,230 B1 2/2001 Nierode
6,286,599 B1 9/2001 Surjaatmadja et al.
6,333,699 B1 12/2001 Zierolf
6,386,288 B1 5/2002 Snider et al.
6,394,184 B2 5/2002 Tolman et al.
6,520,255 B2 2/2003 Tolman et al.
6,536,524 B1 3/2003 Snider
6,543,538 B2 4/2003 Tolman et al.
6,575,247 B2 6/2003 Tolman et al.
6,644,412 B2 * 11/2003 Bode et al. ..... 166/373
6,662,874 B2 12/2003 Surjaatmadja et al.
6,672,405 B2 1/2004 Tolman et al.
6,675,891 B2 * 1/2004 Hailey et al. ..... 166/228
6,719,054 B2 4/2004 Cheng et al.
6,725,933 B2 4/2004 Middaugh et al.
6,759,968 B2 7/2004 Zierolf
6,761,219 B2 7/2004 Snider et al.
6,880,638 B2 * 4/2005 Haughom et al. ..... 166/316
6,951,331 B2 * 10/2005 Haughom et al. ..... 251/180
6,994,170 B2 * 2/2006 Echols ..... 166/386
7,128,152 B2 * 10/2006 Anyan et al. ..... 166/278
7,128,160 B2 * 10/2006 Anyan et al. ..... 166/374
2002/0093431 A1 7/2002 Zierolf
2002/0157837 A1 * 10/2002 Bode et al. ..... 166/373
2002/0158120 A1 10/2002 Zierolf
2002/0166665 A1 * 11/2002 Vincent et al. ..... 166/291
2003/0070809 A1 * 4/2003 Schultz et al. ..... 166/278
2003/0090390 A1 5/2003 Snider et al.
2003/0111224 A1 * 6/2003 Hailey et al. ..... 166/278
2003/0127227 A1 * 7/2003 Fehr et al. ..... 166/306
2004/0040707 A1 3/2004 Dusterhoft et al.
2004/0050551 A1 3/2004 Jones
2004/0055749 A1 3/2004 Lonnes et al.
2004/0092404 A1 * 5/2004 Murray et al. ..... 507/100
2004/0118564 A1 6/2004 Themig et al.
2004/0129422 A1 7/2004 Themig
2004/0238168 A1 * 12/2004 Echols ..... 166/278
2005/0178552 A1 * 8/2005 Fehr et al. ..... 166/305.1
2006/0076133 A1 * 4/2006 Penno ..... 166/278
2006/0124311 A1 * 6/2006 Lopez de Cardenas et al. . 166/313
2006/0124312 A1 * 6/2006 Rytlewski et al. ..... 166/313
2006/0124315 A1 * 6/2006 Frazier et al. ..... 166/369
2006/0207763 A1 * 9/2006 Hofman ..... 166/281
2006/0207764 A1 * 9/2006 Rytlewski ..... 166/313
2006/0207765 A1 * 9/2006 Hofman ..... 166/313

* cited by examiner

SYSTEM FOR COMPLETING MULTIPLE WELL INTERVALS

BACKGROUND OF THE INVENTION

1. Field of the Invention

The present invention relates generally to recovery of hydrocarbons in subterranean formations, and more particularly to a system and method for delivering treatment fluids to wells having multiple production zones.

2. Background of the Invention

In typical wellbore operations, various treatment fluids may be pumped into the well and eventually into the formation to restore or enhance the productivity of the well. For example, a non-reactive "fracturing fluid" or a "frac fluid" may be pumped into the wellbore to initiate and propagate fractures in the formation thus providing flow channels to facilitate movement of the hydrocarbons to the wellbore so that the hydrocarbons may be pumped from the well. In such fracturing operations, the fracturing fluid is hydraulically injected into a wellbore penetrating the subterranean formation and is forced against the formation strata by pressure. The formation strata is forced to crack and fracture, and a proppant is placed in the fracture by movement of a viscous-fluid containing proppant into the crack in the rock. The resulting fracture, with proppant in place, provides improved flow of the recoverable fluid (i.e., oil, gas or water) into the wellbore. In another example, a reactive stimulation fluid or "acid" may be injected into the formation. Acidizing treatment of the formation results in dissolving materials in the pore spaces of the formation to enhance production flow.

Currently, in wells with multiple production zones, it may be necessary to treat various formations in a multi-staged operation requiring many trips downhole. Each trip generally consists of isolating a single production zone and then delivering the treatment fluid to the isolated zone. Since several trips downhole are required to isolate and treat each zone, the complete operation may be very time consuming and expensive.

Accordingly, there exists a need for systems and methods to deliver treatment fluids to multiple zones of a well in a single trip downhole.

SUMMARY

The present invention relates to a system and method for delivering a treatment fluid to a well having multiple production zones. According to some embodiments of the present invention, a well completion system having one or more zonal communication valves is installed and/or deployed in a wellbore to provide zonal isolation and establish hydraulic communication with each particular well zone for facilitating delivery of a treatment fluid.

Other or alternative embodiments of the present invention will be apparent from the following description, from the drawings, and from the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. Moreover, the term "sealing mechanism" includes: packers, bridge plugs, downhole valves, sliding sleeves, baffle-plug combinations, polished bore receptacle (PBR) seals, and all other methods and devices for temporarily blocking the flow of fluids through the wellbore. Furthermore, the term "treatment fluid" includes any fluid delivered to a formation to stimulate production including, but not limited to, fracing fluid, acid, gel, foam or other stimulating fluid.

Generally, this invention relates to a system and method for completing multi-zone wells by delivering a treatment fluid to achieve productivity. Typically, such wells are completed in stages that result in very long completion times (e.g., on the order of four to six weeks). The present invention may reduce such completion time (e.g., to a few days) by facilitating multiple operations, previously done one trip at a time, in a single trip.

Figure 1:
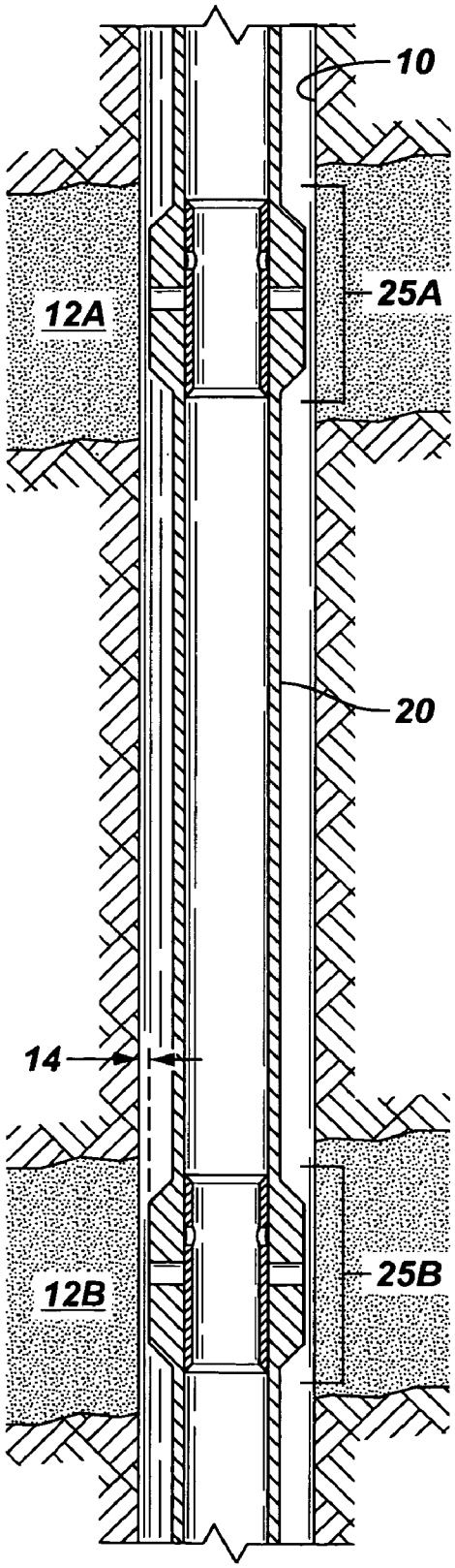
FIG. 1 illustrates a profile view of an embodiment of the multi-zonal well completion system of the present invention having zonal communication valves being installed/deployed in a wellbore.

FIG. 1 illustrates an embodiment of the well completion system of the present invention for use in a wellbore 10. The wellbore 10 may include a plurality of well zones (e.g., formation, production, injection, hydrocarbon, oil, gas, or water zones or intervals) 12A, 12B. The completion system includes a casing 20 having one or more zonal communication valves 25A, 25B arranged to correspond with each formation zone 12A, 12B. The zonal communication valves 25A, 25B function to regulate hydraulic communication between the axial bore of the casing 20 and the respective formation zone 12A, 12B. For example, to deliver a treatment fluid to formation zone 12B, valve 25B is opened and valve 25A is closed. Therefore, any treatment fluid delivered into the casing 20 from the surface will be delivered to zone 12B and bypass zone 12A. The valves 25A, 25B of the well completion system may include any type of valve or various combinations of valves including, but not limited to, sliding or rotating sleeve valves, ball valves, flapper valves and other valves. Furthermore, while this embodiment describes a completion system including a casing, in other embodiments any tubular string may be used including a casing, a liner, a tube, a pipe, or other tubular member.

Regarding use of the well completion system of the present invention, some embodiments may be deployed in a wellbore (e.g., an open or uncased hole) as a temporary completion. In such embodiments, sealing mechanisms may be employed between each valve and within the annulus defined by the tubular string and the wellbore to isolate the formation zones being treated with a treatment fluid. However, in other embodiments the valves and casing of the completion system may be cemented in place as a permanent completion. In such embodiments, the cement serves to isolate each formation zone.

Figure 2A:
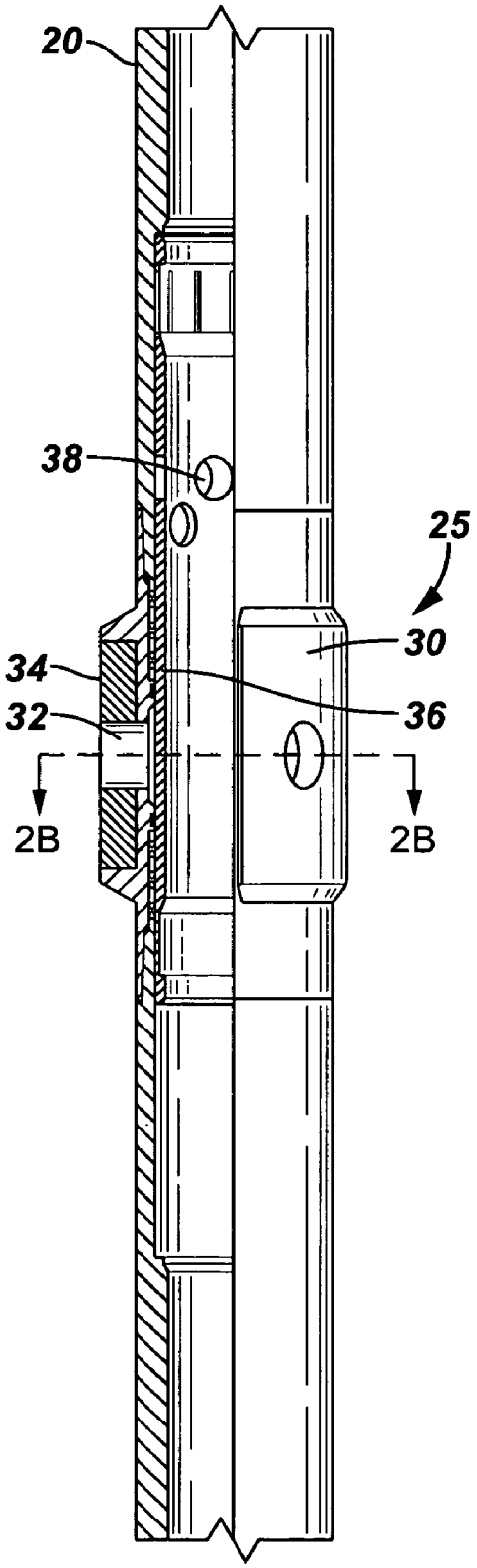
FIGS. 2A-2B illustrate profile and cross-sectional views of an embodiment of a sliding sleeve zonal communication valve of the present invention.
Figure 2B:
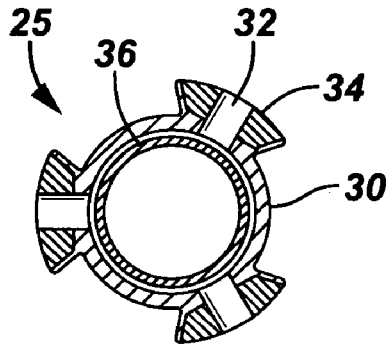

FIGS. 2A and 2B illustrate an embodiment of a zonal communication valve 25. The valve 25 includes an outer housing 30 having an axial bore therethrough and which is connected to or integrally formed with a casing 20 (or other tubular string). The housing 30 has a set of housing ports 32 formed therein for establishing communication between the wellbore and the axial bore of the housing. In some embodiments, the housing 30 also includes a set of "lobes" or protruding elements 34 through which the ports 32 are formed. Each lobe 34 protrudes radially outward to minimize the gap 14 between the valve 25 and wellbore 10 (as shown in FIG. 1), yet cement may still flow through the recesses between the lobes during cementing-in of the casing. By minimizing the gap 14 between the lobes 34 and the formation, the amount of cement interfering with communication via the ports 32 is also minimized. A sleeve 36 is arranged within the axial bore of the housing 30. The sleeve 36 is moveable between: (1) an "open port position" whereby a flowpath is maintained between the wellbore and the axial bore of the housing 30 via the set of ports 32, and (2) a "closed port position" whereby the flowpath between the wellbore and the axial bore of the housing 30 via the set of ports 32 is obstructed by the sleeve 36. In some embodiments, the sleeve 36 includes a set of sleeve ports 38, which are aligned with the set of ports 32 of the housing 30 in the open port position and are not aligned with the set of ports 32 of the housing 30 in the closed port position. In other embodiments, the sleeve 36 does not include ports and the valve 25 is moved between the open port position and the closed port position by moving the sleeve 36 out of proximity of the set of ports 32 and moving the sleeve 36 to cover the set of ports 32, respectively. While in this embodiment, the sleeve 36 is moved between the open port position and closed port position by sliding or indexing axially, in other embodiments, the sleeve may be moved between the open port position and the closed port position by rotating the sleeve about the central axis of the housing 30. Furthermore, while this embodiment of the valve 25 includes a sleeve 36 arranged within the housing 30, in an alternative embodiment, the sleeve 36 may be located external of the housing 30.

Figure 3:
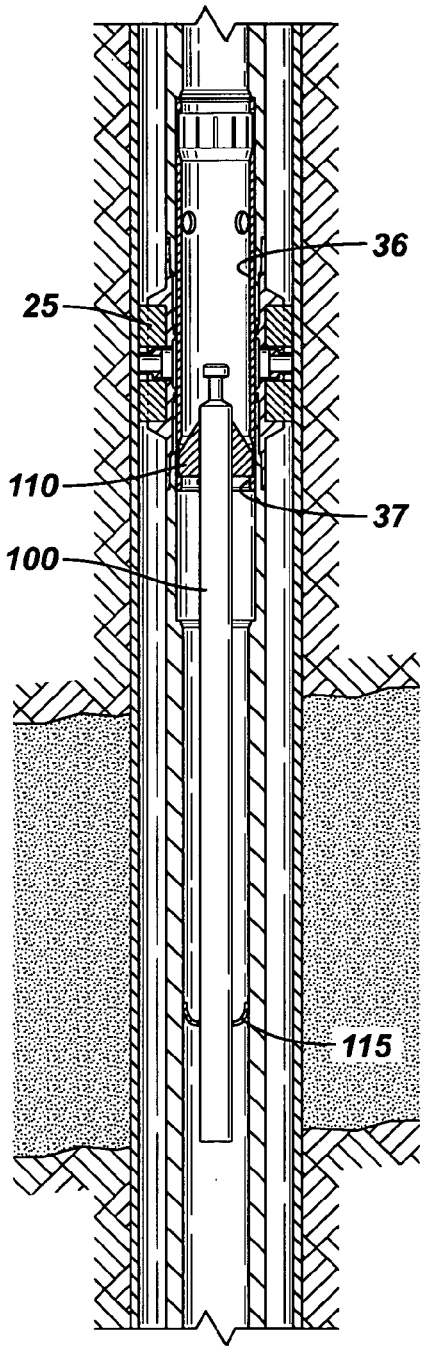
FIG. 3 illustrates a cross-sectional view of an embodiment of an actuating dart for use in actuating the sliding sleeve of the zonal communication valve.

Actuation of the zonal communication valve may be achieved by any number of mechanisms including, but not limited to, darts, tool strings, control lines, and drop balls. Moreover, embodiments of the present invention may include wireless actuation of the zonal communication valve as by pressure pulse, electromagnetic radiation waves, seismic waves, acoustic signals, and other wireless signaling. FIG. 3 illustrates one embodiment of an actuation mechanism for selectively actuating the valves of the well completion system of the present invention. A dart 100 having a latching mechanism 110 (e.g., a collet) may be released into the casing string 20 and pumped downhole to engage a mating profile 37 formed in the sliding sleeve 36 of a valve 25. Once engaging the sleeve, hydraulic pressure behind the dart 100 may be increased to a predetermined level to shift the sleeve between the open port position and the closed port position. Certain embodiments of the dart 100 may include a centralizer 115 (e.g., guiding fins).

Figure 4A:
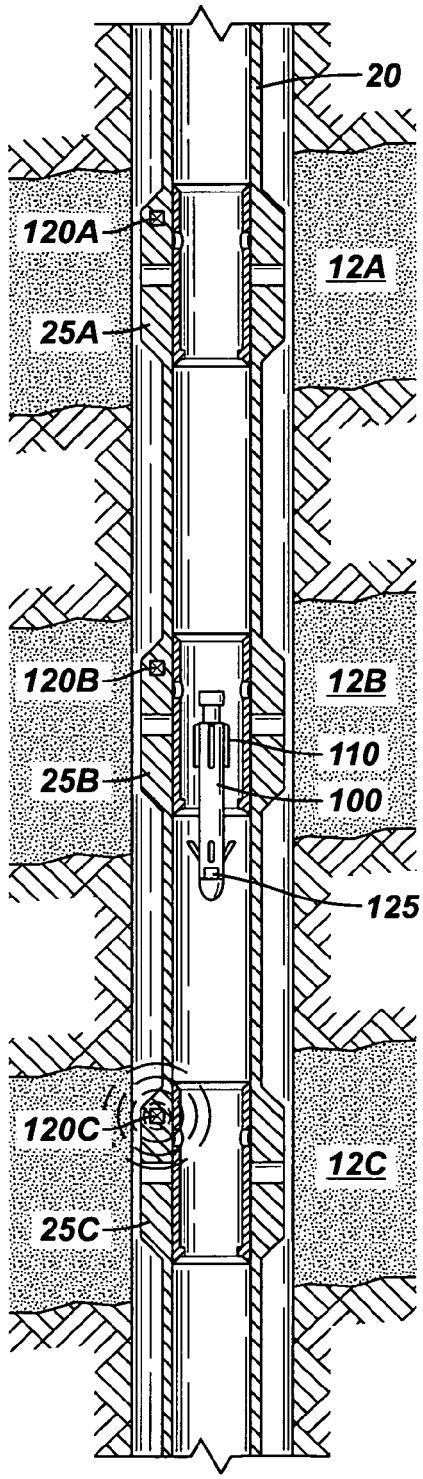
FIGS. 4A-4E illustrates a cross-sectional view of an embodiment of the sliding sleeve zonal communication valve being actuated by a dart using RF receivers/emitters.
Figure 4B:
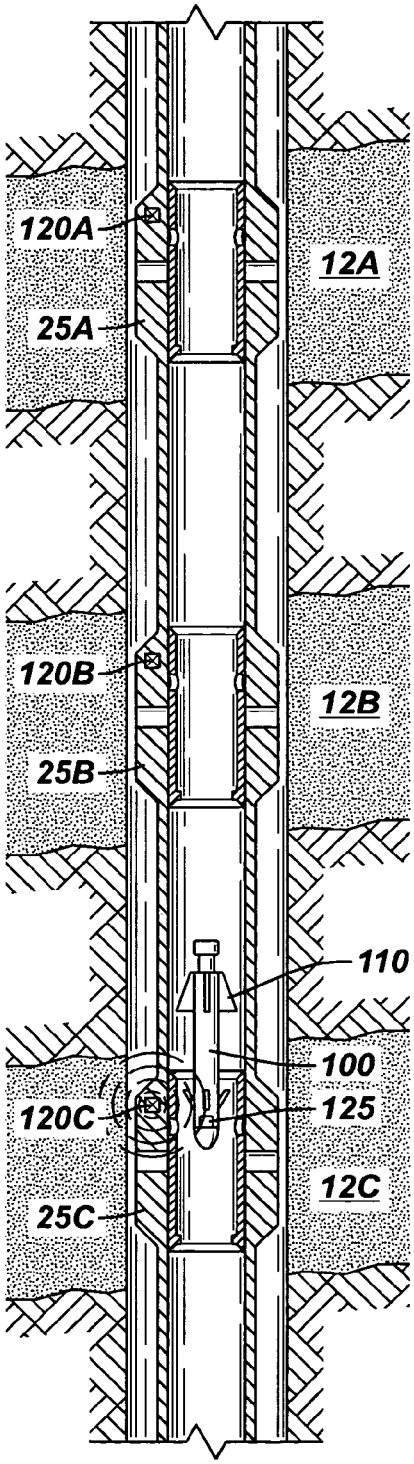
Figure 4C:
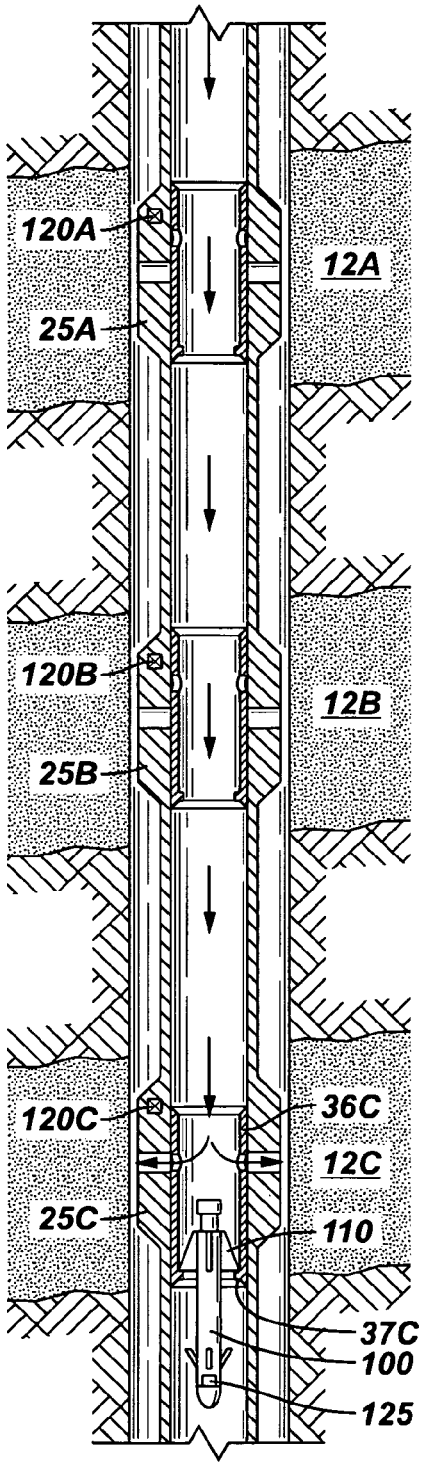

In some embodiments of the dart of the present invention, the latching mechanism 110 is static in that the latching mechanism is biased radially outward to engage the mating profile 37 of the sleeve 36 of the first valve 25 encountered (see FIG. 3). In other embodiments, the latching mechanism 110 is dynamic in that the dart 100 is initially run downhole with the latching mechanism collapsed (as shown in FIG. 4A) and is programmed to bias radially outward upon coming into proximity of a predetermined valve (see FIG. 4B). In this way, the valve 25 of a particular formation interval may be selected for opening to communicate a treatment fluid to the underlying formation. For example, with respect to FIG. 4A, each valve 25A, 25B, 25C includes a transmitter device 120A, 120B, 120C for emitting a particular signal (e.g., a radio frequency "RF" signal, an acoustic signal, a radioactive signal, a magnetic signal, or other signal). Each transmitter 120A, 120B, 120C of each valve 25A, 25B, 25C may emit a unique RF signal. A dart 100 is pumped downhole from the surface having a collet 110 (or other latching mechanism) arranged in a collapsed (i.e., non-radially biased) position. The dart 100 includes a receiver 125 for receiving a particular target RF signal. As the dart 100 passes through valves 25A, 25B emitting a different RF signal, the collet 110 remains collapsed. With respect to FIG. 4B, as the dart 100 comes into proximity of the valve 25C emitting the target RF signal, the collet 110 springs radially outward into a biased position. With respect to FIG. 4C, the biased collet 110 of the dart 100 latches to the mating profile 37C valve of the sleeve 36C. The dart 100 and the sleeve 36C may then be pumped downward until the valve 36C is moved into the open port position whereby delivering a treatment fluid to the formation interval 12C may be achieved.

Figure 4D:
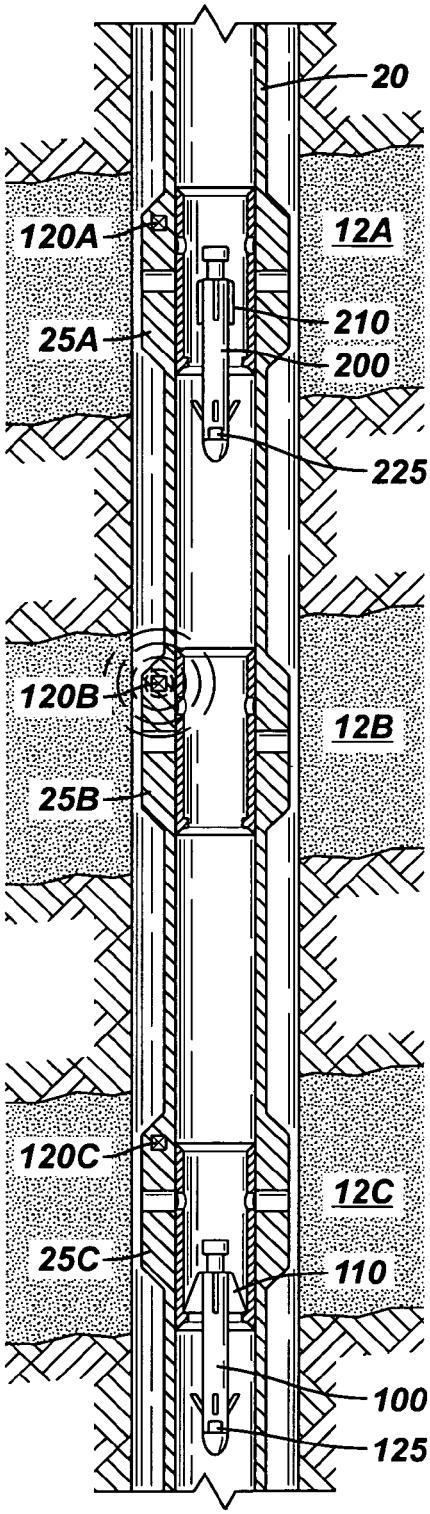
Figure 4E:
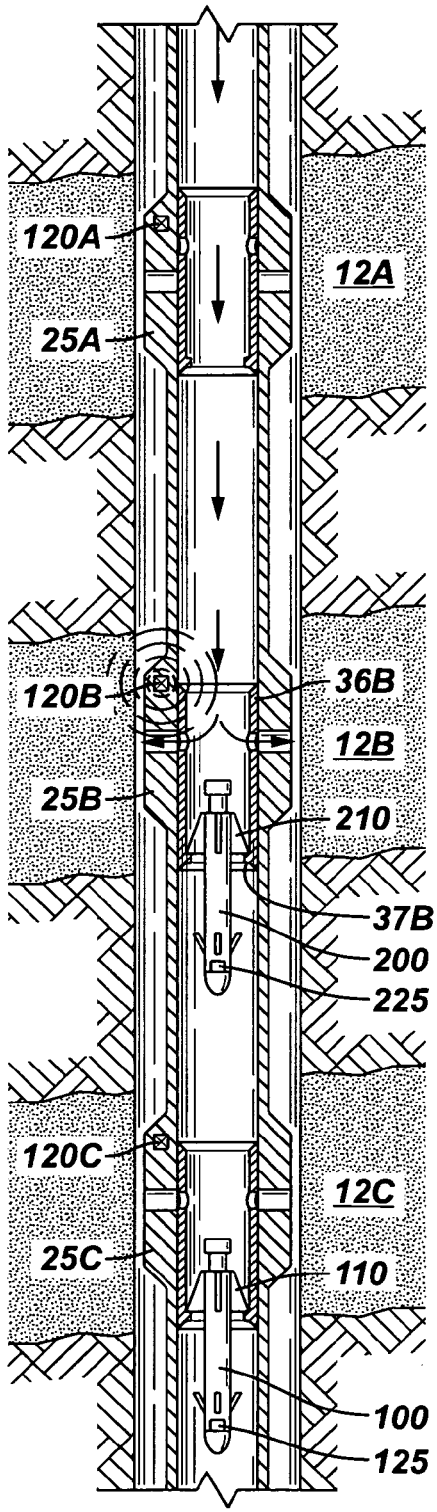

In some embodiments, the dart may include a sealing mechanism to prevent treatment fluid from passing below the dart once it is latched with the sliding sleeve of the valve. With respect to FIG. 4D, in these embodiments, another dart 200 may be released into the casing string 20 and pumped downhole. As with the previous dart 100, the collet 210 of dart 200 remains in a collapsed position until the dart 200 comes into proximity of the transmitter 120B of the valve 25B emitting the target RF signal corresponding to the receiver 225 of the dart 200. With respect to FIG. 4E, once the signal is received, the collet 210 springs radially outward into a biased position to latch and seal with the mating profile 37B of the valve sleeve 36B. The dart 200 and the sleeve 36B may then be pumped downward until the valve 25B is moved into the open port position and whereby valve 25B is isolated from valves 25A and 25C. In this way, a treatment fluid may be delivered to the formation interval 12B. In one embodiment of the present invention, the darts may include a fishing profile such that the darts may be retrieved after the treatment fluid is delivered and before the well is produced.

In another embodiment of the well completion system of the present invention, with reference to FIGS. 11A-11E, instead of pumping a latching mechanism downhole on a dart, a latching mechanism 700 (e.g., a collet) may be run downhole on a work string 705 (e.g., coiled tubing, slickline, drill pipe, or wireline). The latching mechanism 700 is used to engage the sleeve 36A, 36B, 36C to facilitate shifting the sleeve between the open port position and the closed port position. In well stimulation operations, the latching mechanism 700 may be used to open the corresponding valve 25A, 25B, 25C of the formation interval 12A, 12B, 12C targeted for receiving a treatment fluid. In this way, the target formation interval is isolated from any other formation intervals during the stimulation process. For example, in one embodiment, a latching tool 700 having a collet 710 may be run downhole on a slickline 705. The collet 710 includes a plurality of fingers 712 having protruding elements 714 formed on each end for engaging a mating profile 39A, 39B, 39C formed on the inner surface of the sliding sleeve 36A, 36B, 36C of each valve 25A, 25B, 25C. The collet 710 may be actuated between a first position whereby the fingers 712 are retracted (see FIG. 11A) and a second position whereby the fingers are moved to extend radially outward (see FIG. 11B). The collet 710 may be actuated by pressure pulses emitted from the surface for reception by a controller included in the latching tool 700. Alternatively, the latching tool 700 may also include a tension converter such that signals may be delivered to the controller of the latching tool by vertical motion in the slick line 705 (e.g., pulling on the slickline form the surface). In operation, the latching tool 700 is run to the bottom-most valve 25C with the collet 710 in the first retracted position. Once the latching tool 700 reaches the target depth proximate the formation interval 12C, the collect 710 is activated from the surface to extend the fingers 712 radially outward such that the elements 714 engage the mating profile 39C of the sliding sleeve 36C. The latching tool 700 is pulled axially upward on the slickline 705 to shift the sliding sleeve 36C from the closed port position to the open port position, thereby permitting delivery of a treatment fluid into the underlying formation interval 12C. After treating the formation interval 12C, the latching tool 700 is again pulled axially upward on the slickline 705 to shift the sliding sleeve 36C from the open port position to the closed port position. The collet 710 is then again actuated to retract the plurality of fingers 712 and disengage from the sliding sleeve 36C. The latching mechanism 100 may then be moved upward to the next valve 25B such that the valve may be opened, a treatment fluid may be delivered to the formation interval 12B, and then the valve may be closed again. This process may be repeated for each valve in the well completion system.

Figure 5A:
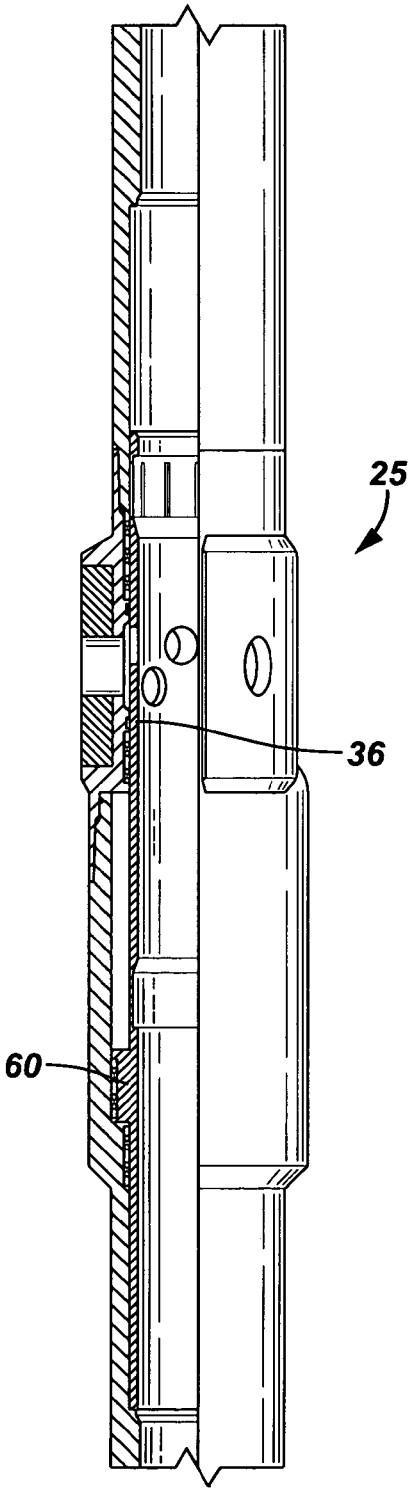
FIG. 5A illustrates a cross-sectional view of an embodiment of the zonal communication valve having an integral axial piston for actuating the sleeve.
Figure 5B:
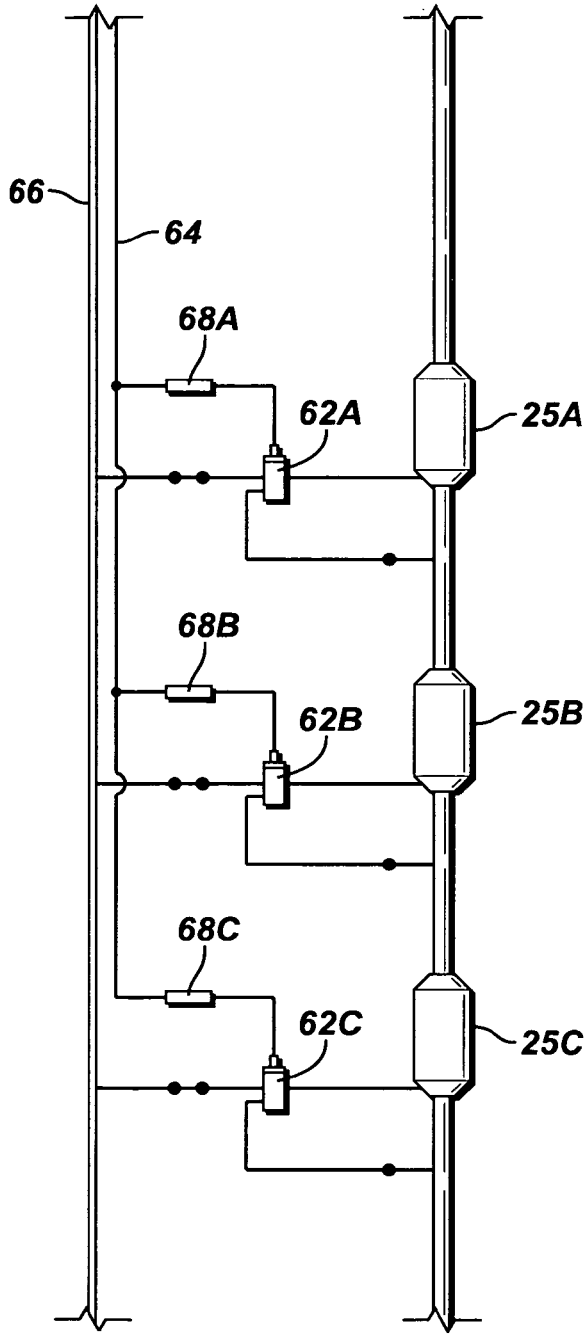
FIG. 5B illustrates a schematic view of an embodiment of the well completion system of the present invention having a control line network for actuating one or more zonal communication valves.

In yet other embodiments of the present invention, the valves of the well completion system may be actuated by a network of control lines (e.g., hydraulic, electrical, fiber optics, or combination). The network of control lines may connect each of the valves to a controller at the surface for controlling the position of the valve. With respect to FIGS. 5A-5B, each valve 25A, 25B, 25C includes an integral axial piston 60 for shifting the sleeve 36 between the open port position and the closed port position and a solenoid 62A, 62B, 62C for energizing the piston of each valve 25A, 25B, 25C. An embodiment of this network may include an individual control line for every valve 25 running to the surface, or may only be a single electric control line 64 and a hydraulic supply line 66. With regard to the embodiment including the single electric control line 64, a unique electrical signal is sent to an addressable switch 68A, 68B, 68C electrically connected to a solenoid 62A, 62B, 62C. Each addressable switch 68A, 68B, 68C recognizes a unique electric address and passes electric power to the respective solenoid 62A, 62B, 62C only when the unique signal is received. Each solenoid 62A, 62B, 62C ports hydraulic pressure from the supply line or vents hydraulic pressure to the formation, casing or back to surface. When activated each solenoid 62A, 62B, 62C moves the sleeve 36 between the open port position and the closed port position.

Figure 6:
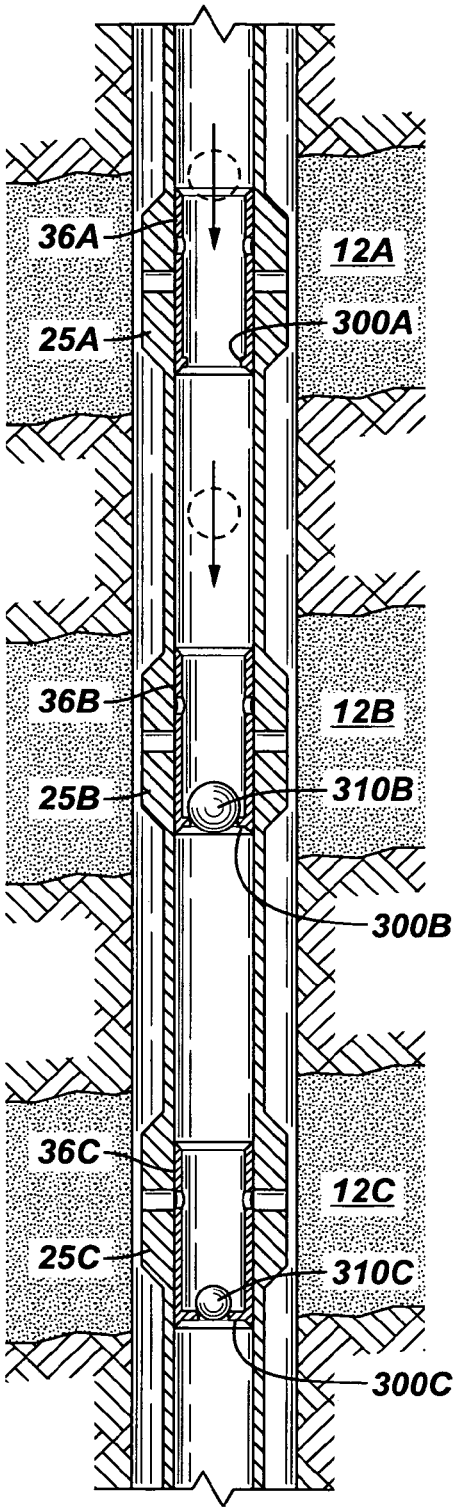
FIG. 6 illustrates a profile view of an embodiment of the multi-zonal well completion system of the present invention having zonal communication valves being actuated by one or more drop balls.

In still other embodiments of the well completion system of the present invention, the actuation mechanism for actuating the valves may include a set of drop balls. With respect to FIG. 6, the valves 25A, 25B, 25C may each include a drop ball seat 300A, 300B, 300C for landing a drop ball in the sleeve 36A, 36B, 36C and sealing the axial bore therethrough. Pressure can then be applied from the surface behind the drop ball to shift each sleeve 36A, 36B, 36C between the open port position and closed port position. In one embodiment, each valve may have a seat sized to catch a ball of a particular size. For example, the seat 300B of an upper valve 25B may have an axial bore therethrough having a diameter larger than the seat 300C of a lower valve 25C such that the drop ball 310C for actuating the lower valve 25C may pass through the axial bore of the seat 300B of the upper valve 25B. This permits opening of the lower valve 25C first, treating the formation 12C, then opening the upper valve 25B with drop ball 310B and treating the formation 12B. As with the darts, the balls may seal with the seats to isolate the lower valves during the delivery of a treatment fluid.

Figure 7:
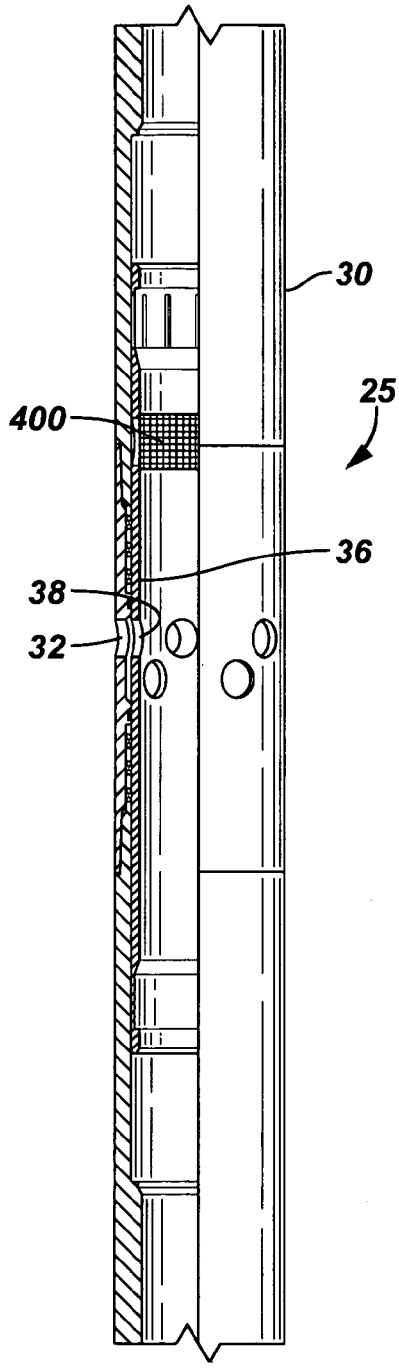
FIG. 7 illustrates a cross-sectional view of a sliding sleeve zonal communication valve having an additional filtering position.

FIG. 7 illustrates another embodiment of a zonal communication valve 25 for use with the well completion system of the present invention. As with the embodiment shown in FIG. 2, the valve 25 includes a housing 30 having a set of housing ports 32 formed therein and a sliding sleeve 36 having a set of corresponding sleeve ports 38 formed therein. However, in this embodiment, the sleeve 36 also includes a filter 400 formed therein. When aligned with the set of housing ports 32 of the housing 30, the filter 400 of the sleeve 36 provides a third position in which the valve 25 may operate. In well operations, an embodiment of the valve 25 includes three positions: (1) closed, (2) fully open to deliver a treatment fluid, and (3) open through a filter 400.

The "filtering position" may be selected to prevent proppant or alternatively for traditional sand control (i.e., to prevent produced sand from flowing into the wellbore). The filter 400 may be fabricated as any conventional sand control screen including, but not limited to, slotted liner, wire wrapped, woven wire cloth, and sintered laminate sand control media.

Figure 8A:
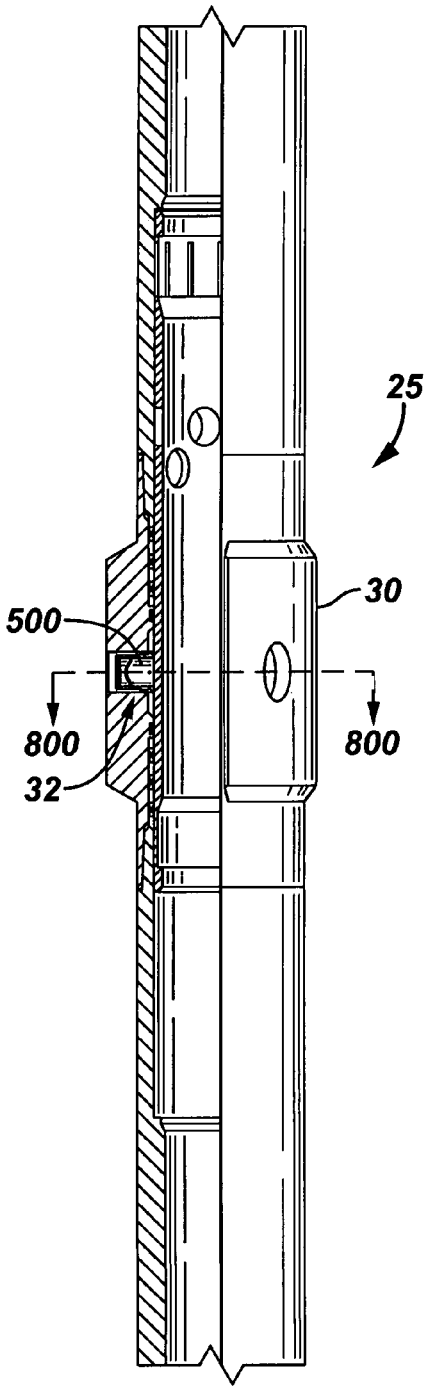
FIGS. 8A-8D illustrate cross-sectional views of various embodiments of pump-out piston ports of a zonal communication valve.
Figure 8B:
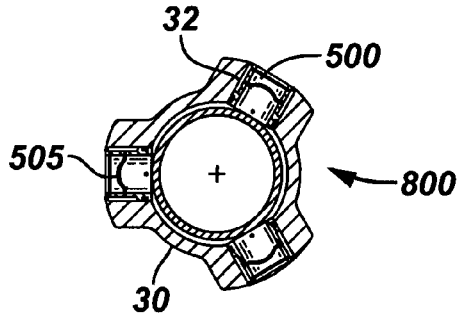
Figure 8C:
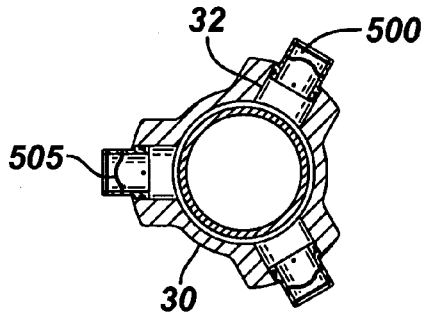
Figure 8D:
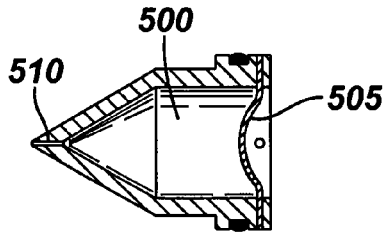

FIGS. 8A-8C illustrate yet another embodiment of the zonal communication valve 25 of for use with the cemented-in well completion system of the present invention. In this embodiment, each port 32 of the housing 30 includes an extendable piston 500 (see cross-section 800 in FIG. 8B) having an axial bore therethrough for defining a flowpath between the formation and the axial bore of the valve 25. Each piston 500 may be extended to engage the formation and seal against cement intrusion during the cementing-in of the casing, thereby permitting cement to flow past the extended pistons. Generally, each valve 25 is run downhole with the casing having the pistons 500 in a retracted position. Once the target depth of the casing is reached, the pistons 500 may be pressurized to extend radially outward and engage and/or seal against the formation. In some embodiments, each piston includes a frangible seal 505 (e.g., a rupture disc) arranged therein for preventing cement from flowing into the piston 500. Once the cement is cured, the valve 25 may be pressurized to break the seal 505 and establish hydraulic communication with the formation. Treatment fluid may then be delivered to the formation via the extended pistons 500. Alternatively, a thin metal flap may be attached the housing to cover the ports and block any flow of cement into valve. In this embodiment, the flap may be torn free from the housing by the pressure of the treatment fluid during stimulation of the underlying interval. In an alternative embodiment of the pistons 500, as shown in FIG. 8D, each piston 500 may be provided a sharp end 510 to provide an initiation point for delivering a treatment fluid once extended to engage the formation. These alternative pistons 500 may be open ended with a frangible seal 505 or have a closed end with no frangible seal (not shown). In the case of a closed end, the sharp, pointed end 510 of the piston 500 would break under pressure to allow hydraulic communication with the formation.

Figure 9A:
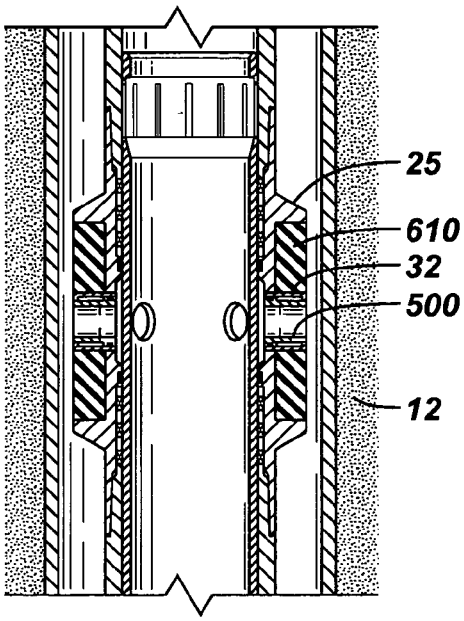
FIGS. 9A-9H illustrate cross-sectional views of an embodiment of a sliding sleeve zonal communication valve being installed in a wellbore.
Figure 9B:
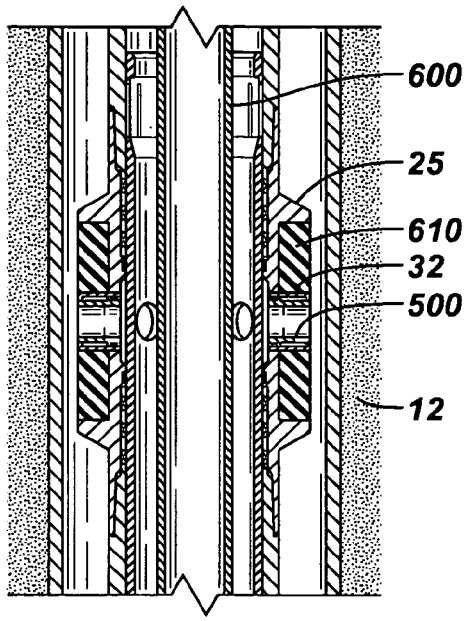
Figure 9C:
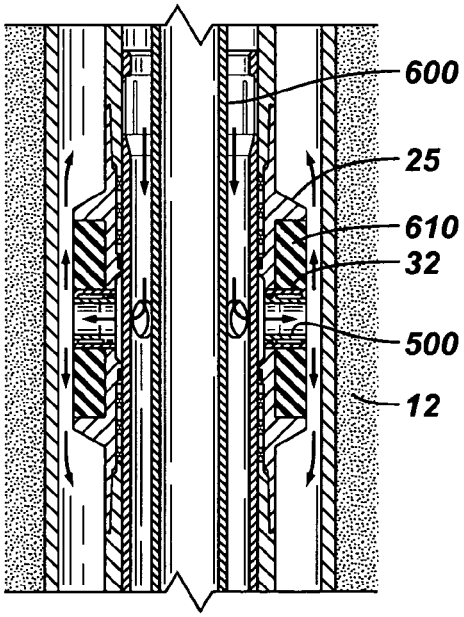
Figure 9D:
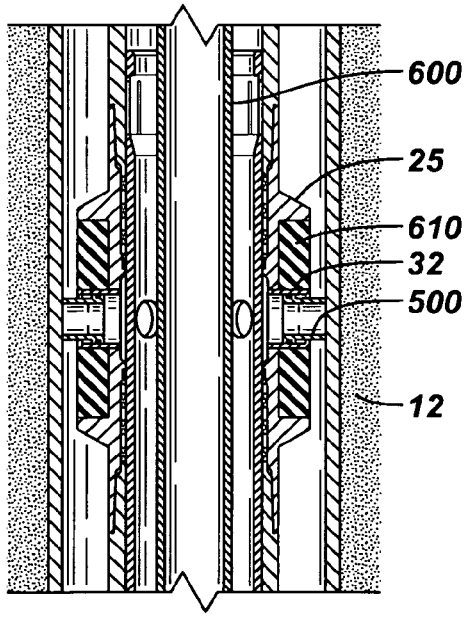
Figure 9E:
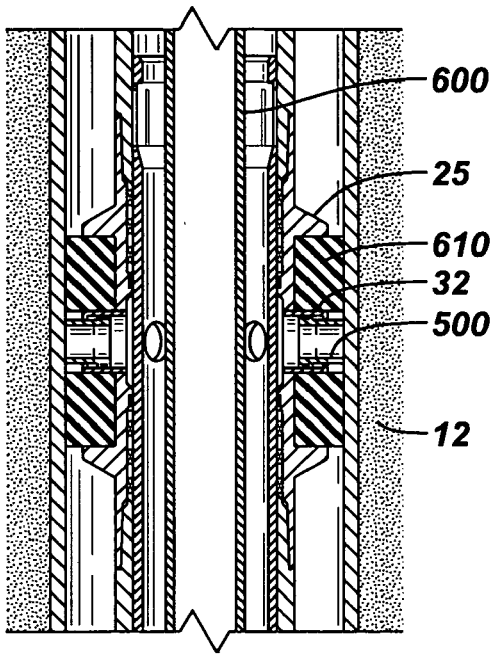
Figure 9F:
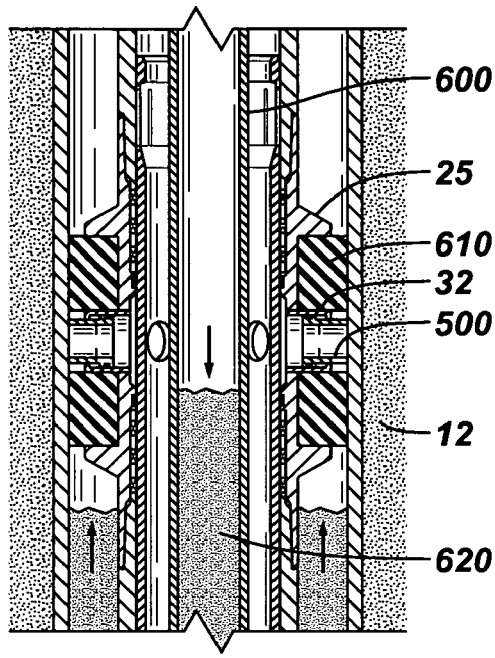
Figure 9G:
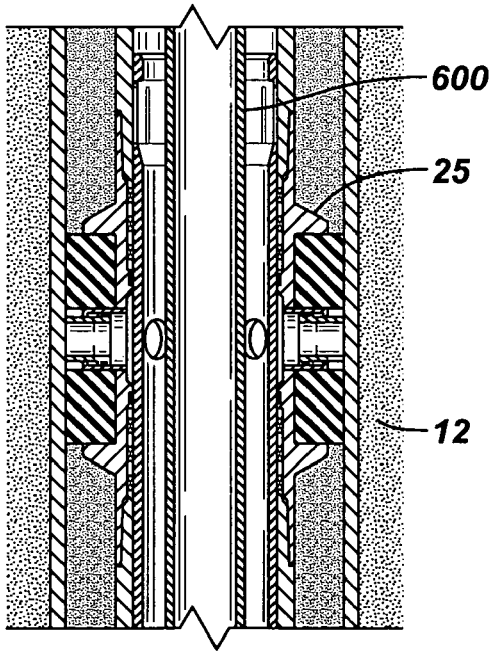
Figure 9H:
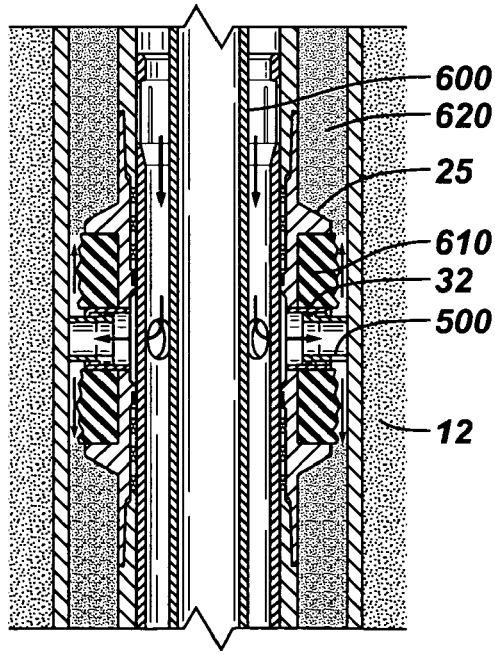

With respect to FIGS. 9A-9H, an embodiment of a procedure for installing the well completions system of the present invention is provided. In this embodiment, the well completion system is integral with a casing string and is cemented in the wellbore as a permanent completion. The cement provides zonal isolation making any mechanical zonal isolation device (external casing packers, swelling elastomer packers, and so forth) unnecessary. First, a casing string having one or more zonal communication valves 25 is run in a wellbore to a target depth where each valve is adjacent to a respective target formation zone 12 (FIG. 9A). A tubing string 600 is run through the axial bore of the casing to the bottom of the casing (FIG. 9B) and creates a seal between the casing and the tubing work string 600 (e.g., by stabbing into a seal bore). Hydraulic pressure is applied from the surface around the tubing string 600 to each valve 25 to actuate the set of pistons 500 in each port 32 and extend the pistons 500 radially outward to engage the target formation 12 (FIGS. 9C and 9D). In some embodiments, the hydraulic housing ports 32 may be packed with grease, wax, or some other immiscible fluid/substance to improve the chance of the tunnel staying open during the cementing operation. In alternative embodiments, the well completion system of the present invention is run downhole without a set of pistons 500 in the ports 32. Moreover, in some embodiments, an expandable element 610 is arranged around the set of ports may be formed of a swellable material (e.g., swellable elastomer blend, swellable rubber, or a swellable hydrogel). This swellable material may react with water, oil, and/or another liquid in the wellbore causing the material to expand outward to form a seal with the formation 12 (FIG. 9E). In some embodiments, the swellable material may be dissolvable after the cementing operation is complete. In alternative embodiments, a frangible material, permeable cement, or other device may be used to prevent cement from entering the valve 25 from the wellbore annulus side. These devices maybe used with the swellable material, which also helps keep cement from entering the valve or the devices may be used in combination with other devices, or alone. After the set of pistons 500 of each valve 25 are extended, cement 620 is pumped downward from the surface to the bottom of the casing via the tubing string 600 and upward into the annulus between the casing and the wellbore (FIGS. 9F and 9G). In one embodiment of the present invention, once cementing of the casing is complete, a liquid may be pumped into the casing to wash the cement away from the set of ports 500 (FIG. 9H). Alternatively, a retardant may be injected into the cement via the set of ports 500 such that the treatment fluid can flush the set of ports and engage the formation interval 12. Moreover, in some embodiments, the external surface of the valve housing 30 may be coated with a slippery or non-bonding material such as Teflon®, Xylan®, Kynar®, PTFE, FEP, PVDF, PFA, ECTFE, or other fluorpolymer coating materials.

Figure 10A:
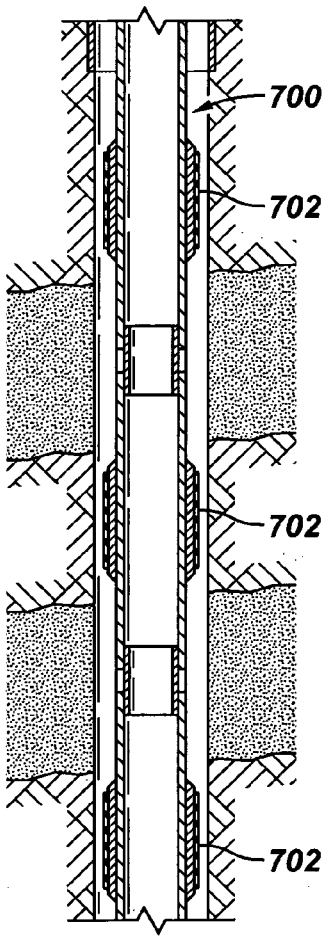
FIGS. 10A-10C illustrate profile views of an embodiment of the well completion system of the present invention being deployment in an open or uncased hole.
Figure 10B:
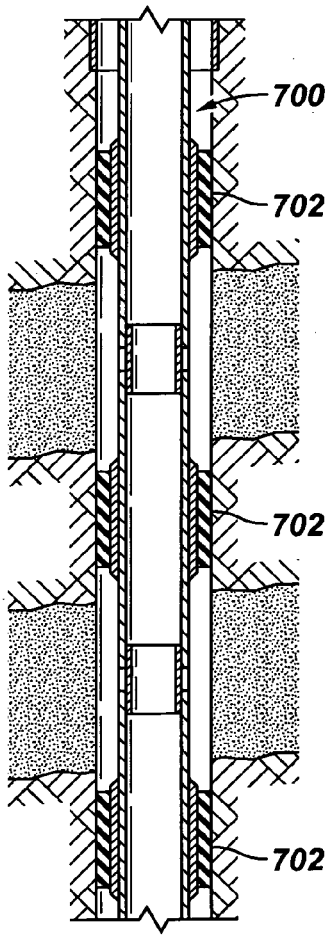
Figure 10C:
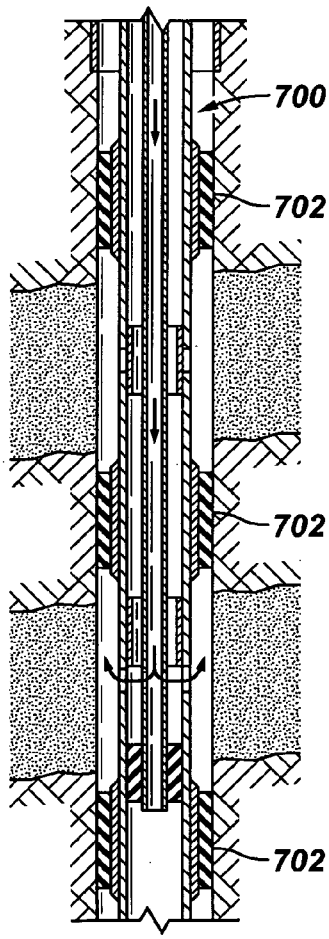
Figure 11A:
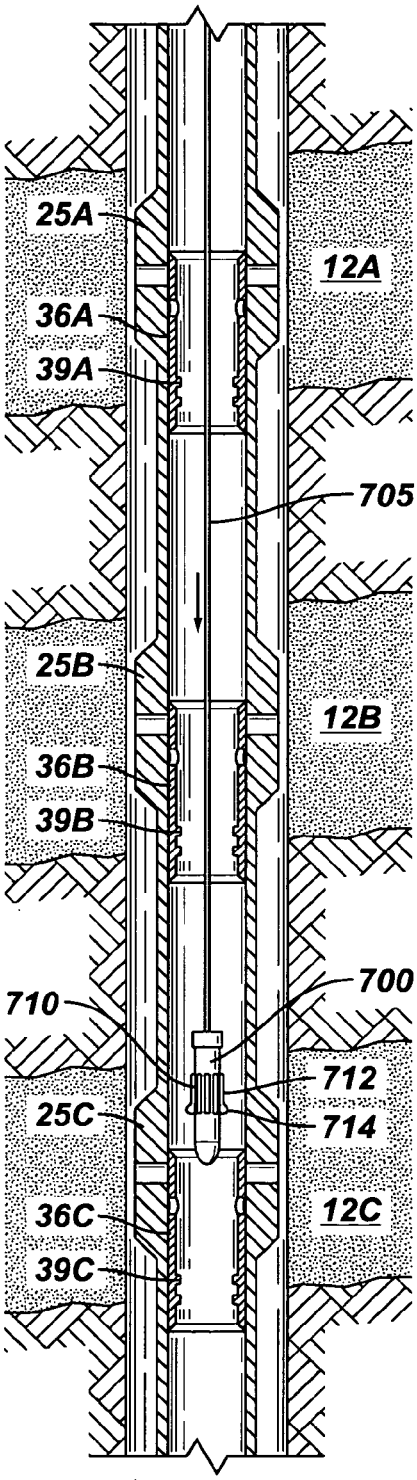
FIGS. 11A-11E illustrate profile views of an embodiment of a plurality of sliding sleeve zonal communication valves being actuated by a latching mechanism suspended by a working string.
Figure 11B:
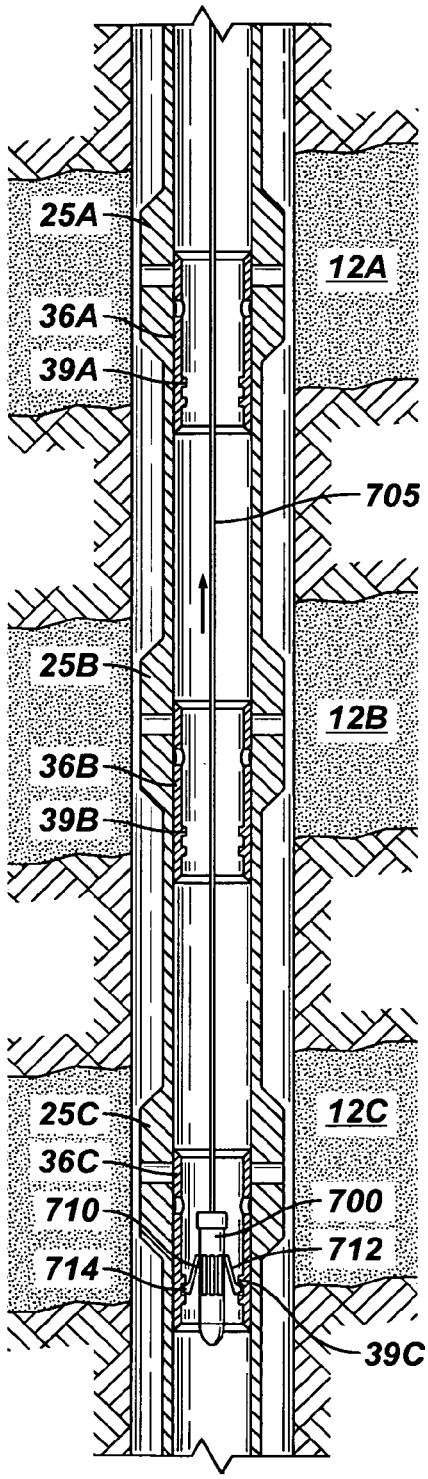
Figure 11C:
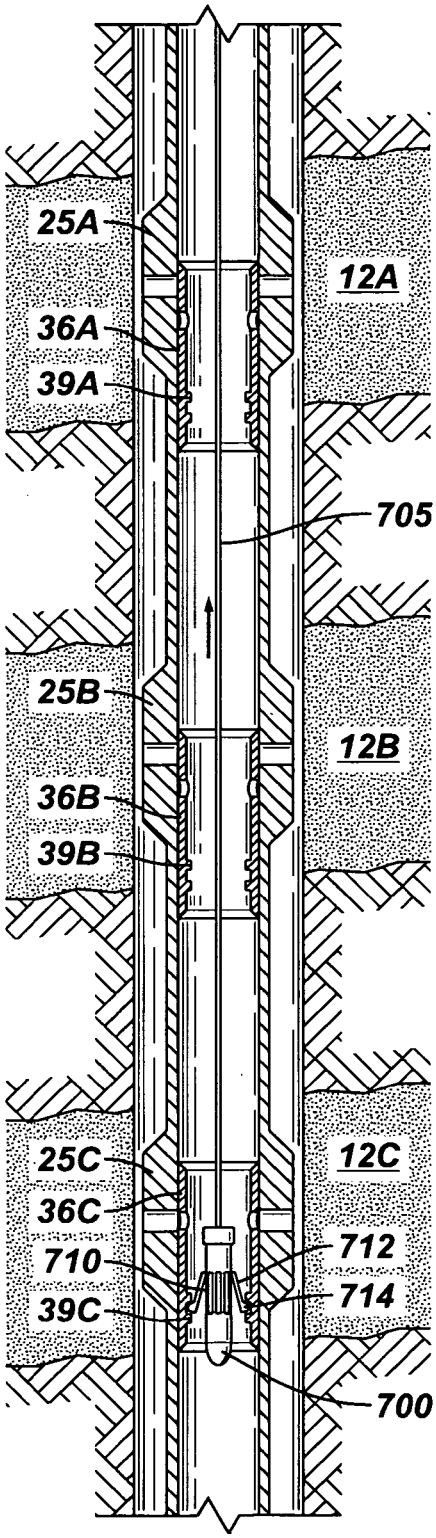
Figure 11D:
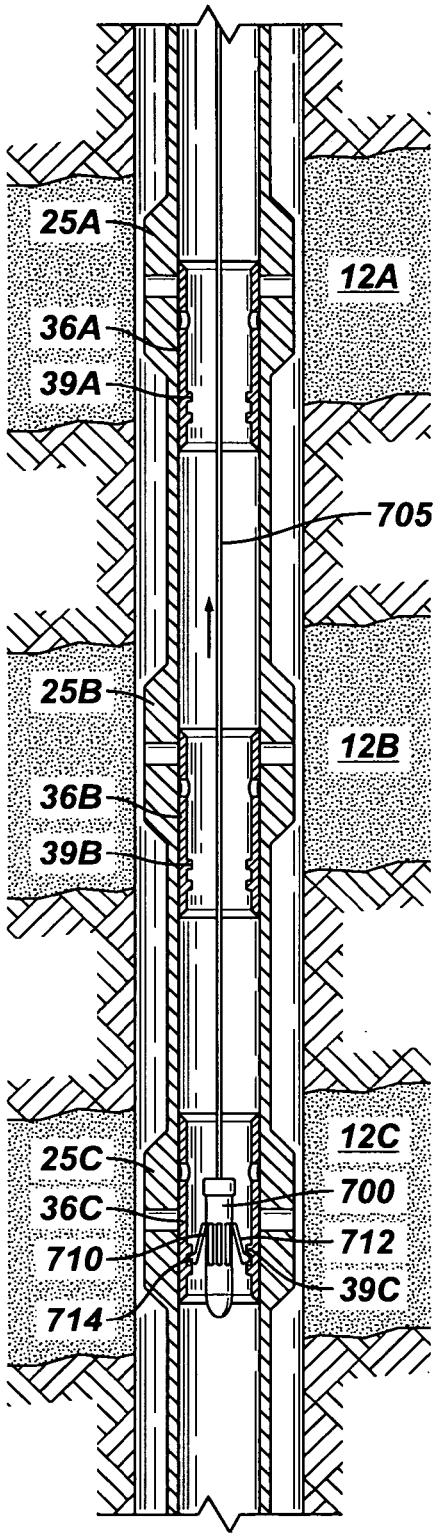
Figure 11E:
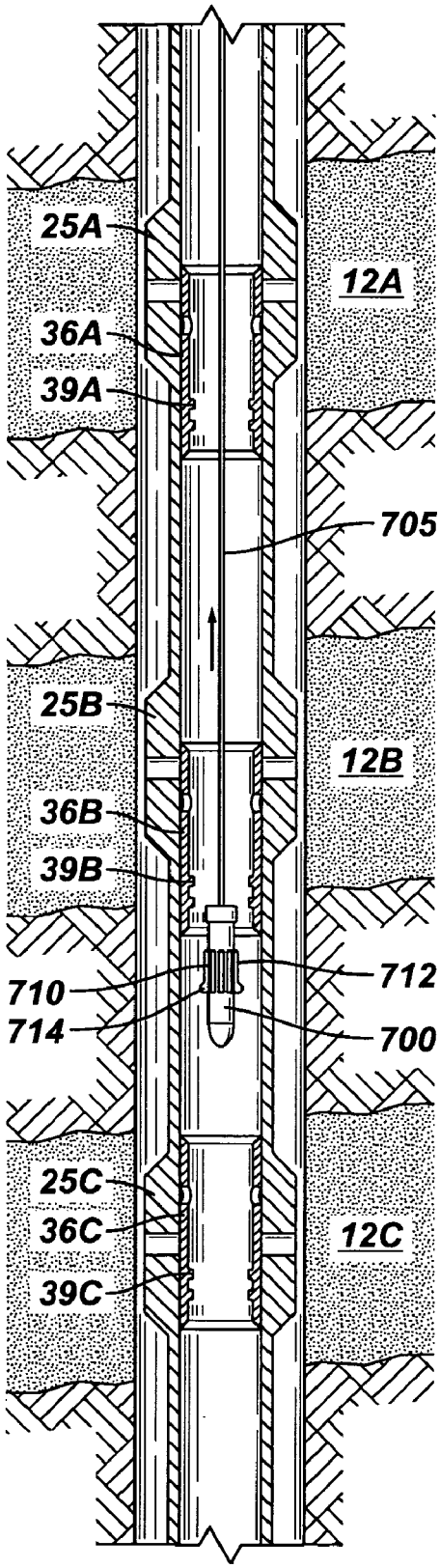

With respect to FIGS. 10A-10C, an embodiment of a procedure for deploying the well completions system of the present invention is provided. In this embodiment, the well completion system is part of a tubular string 700, which includes one or more sealing mechanisms 702 for providing zonal isolation. In operation, the completion system is run in hole to a target depth where the sealing mechanisms 702 are energized. The sealing mechanisms 702 may be set by either pressurizing the entire casing string or by running a separate setting tool through each zonal isolation device. With each production zone isolated from the next, a service tool may be run in hole to treat each zone.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for use in a wellbore having a plurality of well zones, comprising:

a casing deployed in the wellbore; and a plurality of valves connected to the casing, each valve for establishing communication between the casing and a well zone;

wherein the casing is fixed to the wellbore by cement, wherein at least one of the valves comprises a filter moveable between a filtering position at which the filter is aligned with at least one port of the valve and another position in which the filter is not aligned with said at least one port.

2. The system of claim 1, wherein each valve comprises:

a housing having an axial bore therein, the housing having at least one port formed therein for establishing communication between the axial bore of the housing and a well zone; and a sliding sleeve arranged within the housing, the sleeve moveable between an open port position wherein a flowpath exists between the axial bore of the housing and a well zone and a closed port position wherein the flowpath is interrupted.

3. The system of claim 2, wherein the sliding sleeve comprises:

at least one port formed therein, the at least one port of the sleeve being aligned with the at least one port of the housing when the sleeve is in the open port position and the at least one port of the sleeve being misaligned with the at least one port of the housing when the sleeve is in the closed port position.

4. The system of claim 1, further comprising:

a drop ball having a predetermined diameter; and a seat connected to the sleeve, the seat having an axial bore therethrough, the axial bore of the seat having a diameter smaller than the diameter of the drop ball, wherein the drop ball is adapted to engage the seat to shift the sliding sleeve between the open port position and the closed port position.

5. The system of claim 1, further comprising:

an expandable element formed around each port of the housing, the expandable clement adapted to prevent cement from entering the port when activated.

6. The system on claim 5, wherein the expandable element is selected from a group consisting of swellable rubber, swellable hydrogel, and swellable elastomer blend.

7. The system of claim 1, wherein the filter comprises a sand or proppant control filter.

8. A system for use in a wellbore having a well zone, comprising:

a casing deployed in the wellbore, the casing having an axial bore therein; and a valve connected to the casing for establishing communication between the casing and the well zone, the valve moveable between an open position wherein a flowpath exists between the axial bore of the casing and the well zone and a closed port position wherein the flowpath is interrupted, wherein the casing is fixed to the wellbore by cement, the valve has a selectable filtering position to filter fluid communicated from the well zone, and the valve is adapted to, in the selectable filtering position, filter sand or proppant from the fluid communicated from the well zone.

9. The system of claim 8, further comprising:

a drop ball adapted to actuate the valve between the open position and the closed position.

* * * * *